US007939140B2

(12) United States Patent
Elsner

(10) Patent No.: US 7,939,140 B2
(45) Date of Patent: May 10, 2011

(54) CURTAIN COATING PROCESS AND DEVICE USED FOR THIS PURPOSE

(75) Inventor: Christian Elsner, Bielefeld (DE)

(73) Assignee: Mitsubishi HiTec Paper Bielefeld GmbH, Bielefeld (DE)

( * ) Notice: Subject to any disclaimer, the term of this patent is extended or adjusted under 35 U.S.C. 154(b) by 445 days.

(21) Appl. No.: 12/083,656

(22) PCT Filed: Aug. 23, 2007

(86) PCT No.: PCT/EP2007/007411

§ 371 (c)(1),
(2), (4) Date: Apr. 16, 2008

(87) PCT Pub. No.: WO2008/025479

PCT Pub. Date: Mar. 6, 2008

(65) Prior Publication Data

US 2009/0130323 A1 May 21, 2009

(30) Foreign Application Priority Data

Sep. 1, 2006 (EP) ..... 06018364

(51) Int. Cl.
*B05D 1/30* (2006.01)
*B05C 3/02* (2006.01)

(52) U.S. Cl. .... 427/420; 118/413; 118/428; 118/DIG. 4

(58) Field of Classification Search ..... 427/420; 118/413, 428, DIG. 4
See application file for complete search history.

(56) References Cited

U.S. PATENT DOCUMENTS

| | | | | |
|---|---|---|---|---|
| 3,369,522 | A | 2/1968 | Alix | |
| 3,867,901 | A * | 2/1975 | Greiller | 118/50 |
| 5,224,996 | A | 7/1993 | Ghys et al. | |
| 5,370,735 | A | 12/1994 | Beisswanger | |
| 5,624,715 | A | 4/1997 | Gueggi et al. | |
| 5,788,771 | A | 8/1998 | Madrzak et al. | |
| 6,162,502 | A | 12/2000 | Schweizer et al. | |
| 2003/0039761 | A1 * | 2/2003 | Shiraishi et al. | 427/420 |
| 2003/0145785 | A1 * | 8/2003 | Bernert et al. | 118/258 |
| 2005/0100678 | A1 * | 5/2005 | Aust et al. | 427/420 |
| 2006/0124263 | A1 | 6/2006 | Lipponen et al. | |

FOREIGN PATENT DOCUMENTS

| | | |
|---|---|---|
| DE | 198 08 159 | 9/1999 |
| JP | 09 021099 | 1/1997 |
| WO | WO 2005/099911 | 10/2005 |

* cited by examiner

OTHER PUBLICATIONS

Search Report dated Mar. 4, 2008 issued for the underlying International Application No. PCT/EP2007/007411.

*Primary Examiner* — Michael Cleveland
*Assistant Examiner* — Nathan H Empie
(74) *Attorney, Agent, or Firm* — Cohen Pontani Lieberman & Pavane LLP

(57) ABSTRACT

Process and apparatus for applying single and multiple coatings of a liquid coating material to a continuously moving backing web, in which a free-falling, vertical curtain is formed out of the coating material and strikes the backing web along a wetting line. In particular, the present invention pertains to a process for producing heat-sensitive recording material. The backing web is pushed down over its entire width by at least one guide element before it passes through the wetting line, and is lifted by a support in the form of round element extending transversely to the direction of movement of the backing web after the web has passed through the wetting line, where the support also includes an air guide with an angle of 2-15° between the backing web and the top surface of the air guide means.

22 Claims, 1 Drawing Sheet

CURTAIN COATING PROCESS AND DEVICE USED FOR THIS PURPOSE

CROSS-REFERENCE TO RELATED APPLICATIONS

This is a U.S. national stage of International Application No. PCT/EP2007/007411, filed on 23 Aug. 2007. Priority is claimed on European Application No. 06018364.7, filed on 1 Sep. 2006.

BACKGROUND OF THE INVENTION

1. Field of the Invention

The present invention pertains to a process and to a device for applying single or multiple coatings of a liquid coating material to a continuously moving backing web by the curtain coating process, in which a free-falling, vertical curtain of the coating material is formed and strikes the backing web along a wetting line. The present invention pertains in particular to a process for producing a heat-sensitive recording material.

2. Description of the Related Art

As a result of its numerous advantages, which include not only the possibility of applying several layers of different coating liquids simultaneously but also the superior surface properties of the applied coatings, the curtain coating process is firmly established as part of routine production in modern paper processing equipment. Curtain coating processes are often used to produce photo papers and magnetic recording papers, but the areas of application for the curtain coating process have been increasing, and they now include, for example, the production of heat-sensitive and pressure-sensitive recording material, ink-jet receiving media, and pigment-coated recording material, all of which can be considered firmly established prior art applications.

Among the known curtain coating processes, there are in particular two types which are especially important. First is the so-called slot coating process, in which the liquid coating material emerges through a downward-pointing outlet slot arranged transversely above the web-like base material to be coated. As the liquid leaves the slot, it immediately forms a free-falling liquid curtain. Second is the so-called slide-surface coating process. Here the liquid coating material is first applied to a downward-slanting slide, where it forms a thin film and flows down the slide under the effect of gravity, forming the free-falling liquid curtain at the end of the slide.

Independently of the type of design used to form the liquid curtain, there are numerous problems to be solved after the liquid curtain has formed. These involve, for example, the problem of stabilizing the liquid curtain and the problem of applying it as uniformly as possible to the continuously moving backing web.

One of these problems results in particular from the air carried along by the backing web when the attempt is made to operate at high speed. During the coating process, this air causes a permanent dynamic distortion of the wetting line. According to the invention, the "wetting line" is the line where the liquid curtain intersects the continuously moving web of base material. This line extends transversely across the backing web, and in the ideal case it is static and straight. Coating defects such as nonuniform thickness of the applied coating material and production breakdowns caused by the complete or even partial breaking-away of the liquid curtain are typical consequences of pronounced distortions of the wetting line.

Numerous proposals for solving this long-known and especially unpleasant problem have been made in the past. They have the goal in particular of stabilizing the liquid curtain by means of air suction devices such as that described in, for example, EP 0 489 978 B, which corresponds to U.S. Pat. No. 5,224,996. The air suction device is intended to have here the form of a concave air shield with various air chambers, which extend around a deflecting roller for the material web to be coated. The air shield is bounded by two end regions, at which various components such as brushes are used to increase the air resistance. The components are prevented from coming in direct contact with the material web because such contact would slow down production, i.e., a problem which could not be solved at that time.

Various air guide systems have already been proposed in the past to produce an air stream oriented against the direction of movement of the material web to be coated, i.e., an air stream which, beginning just in front of the wetting line, is applied directly above the material web to be coated to separate and to carry away the air entrained by the material web. All of these devices provide an air supply in the immediate vicinity of the liquid curtain and an air exhauster a certain distance farther away from the liquid curtain. Whereas U.S. Pat. No. 6,162,502 and, similarly, U.S. Pat. No. 5,624,715 implement this type of air guide system with concavely designed air shields extending around a material web being conveyed along a circular path, DE 198 08 159 A proposes an air shield which is set down on a material web being guided along a straight path.

According to a proposal of the general type in question in U.S. Pat. No. 3,369,522, a material web to be coated by a curtain coating process is deflected slightly downward between two guide rollers—one located upstream, the other and downstream of the wetting line—by a doctor located a certain distance upstream of the wetting line. The doctor forms an airtight shield for the air being carried by the material web toward the liquid curtain and is supposed to prevent more-or-less completely the interfering effects caused by the movements of air toward the liquid curtain. According to another embodiment, a hollow doctor, open at the bottom, is provided, which can also suction off the air.

Numerous experiments have shown the disadvantages of the known prior art in the form of coating defects such as skipping especially in the upper speed range above 1,200 m/min and especially clearly at speeds above 1,500 m/min. The task of the present invention is therefore to make available a process for applying single or multiple coatings of a liquid coating material to a continuously moving backing web by the curtain coating process and a device for implementing the process which still functions without difficulty even at very high production speeds.

To explain the previously described disadvantages of the prior art in question and also to overcome them, it was necessary, as part of the preparation of this document, to conduct studies to analyze the process of curtain coating as closely as possible:

In the process for applying single or multiple coatings by the curtain coating process, a very thin coating film is applied to a very fast and continuously moving backing web. When for this purpose the liquid coating material leaves the outlet slot of the slot coater or, so as not to be limited in any way in this respect, from the slide of the slide-surface coater, the actual curtain of coating material is formed, which then falls vertically downward under the force of gravity. At the moment the liquid coating material strikes the backing web along the wetting line, the vertical movement of this coating material is deflected in a direction which corresponds to the direction of movement of the backing web downstream of the wetting line, a movement which, according to the invention, preferably rises slightly. As the result of small vibrations of the backing web in the area of the wetting line, vibrations which are almost impossible for the human observer to see or feel and which are referred to in the present document as microvibrations, the surface of the backing web located under the arriving curtain moves at times faster vertically downward than the coating material in the curtain, especially when the web is traveling at very high speeds. As a result of these microvibrations, i.e., "microcycles", skipping occurs at regular intervals, which means that the finished coating film has defects. If the coating material is a functional coating composition such as a heat-sensitive coating composition, which is preferably the case in the present document, the function of the coating film is considerably disturbed in the defect locations: the recording material thus produced is unusable.

The inventors were able to explain that the above-mentioned microvibrations are caused by the extremely rapid rises and falls of the backing web on the guide rollers known according to the prior art which serve as support means for the backing web downstream of the wetting line. This rising and falling, as the inventors discovered, is promoted by the rapid rotation of the guide rollers downstream of the wetting line. These rollers, designed with the typical diameters of 20-40 cm, draw in large amounts of air on their inlet side between the surface of the roller and the bottom surface of the backing web. A kind of air cushion forms, on which the backing web floats. This air cushion prevents the backing web from resting effectively on the guide rollers, and it can even cause the backing web to generate microvibrations when small surface irregularities on the guide rollers and/or the bottom surface of the backing web produce irregularities in the flow of air. On the outlet side, furthermore, not enough force is built up to press the backing web down onto the guide rollers. On the basis of these detailed observations and the accompanying interpretation of them, the inventors ultimately succeeded in solving the underlying problem.

SUMMARY OF THE INVENTION

What is proposed is a process for applying single or multiple coatings of a liquid coating material to a continuously moving backing web (1) by the curtain coating process, in which a free-falling vertical curtain (2) of the coating material is formed and strikes the backing web (1) along a wetting line (3), where the web is pressed down over its entire width by at least one guide element (4) before passing through the wetting line (3) and is raised over its entire width by at least one support means (5) after passing through the wetting line (3). According to the invention, the minimum of one support means (5) comprises a round element (6) extending transversely to the direction of movement of the backing web (1), and an air guide means (7), situated behind the round element (6) with respect to the direction of movement of the backing web (1); where the angle ($\alpha$) between the backing web (1) and the top surface of the air guide means (7) is set to a value in the range of 2-15°.

An essential aspect of the invention is that the top surface of the air guide means (7) holds the backing web (1) in place by the negative pressure which results at high velocities of the backing web (1) when the angle ($\alpha$) between the backing web (1) and the top surface of the air guide means (7) is in the inventive range of 2-15°, preferably in the range of 2.5-10.5°, and especially in the range of 2.8-5.5°, the air guide means thus functioning as a vibration damper for the microvibrations of the backing web (1). Experiments showed that polyurethane is especially suitable as a material for the air guide means (7). By limiting the radius of the side of the round element (6) facing the backing web (1), specifically the radius of the front surface facing the wetting line, to values below 12 mm, preferably to values below 8 mm, more preferably to values in the range of 4.5-8 mm, and especially to values in the range of 6.5-7 mm, the quantity of air which is introduced on the inlet side between the backing web (1) and the forward edge of the round element (6) is reduced, which thus effectively prevents the backing web from floating on the top surface of the air guide means (7).

The random positioning of a working part made of sheet metal bent into a round shape, for example, can serve as the round element (6) according to the present invention. It is considered especially advantageous for the round element (6) and the air guide element (7) to be designed as a single unit and/or to be positively connected to each other.

The round element (6) is preferably a doctor bar, in which case it is considered especially advantageous for the air guide means (7) to be designed as a holder for the round element or for the doctor bar. In one type of design, the doctor bar does not rotate during operation. In other designs, it rotates in the same direction as the backing web (1); that is, the surface of the doctor bar in the contact area with the backing web (1) moves in the same direction as the backing web (1). In yet other designs, the doctor bar and the backing web (1) move in opposite directions. All of these designs are considered preferred in accordance with the present specification. Even if the diameter of the doctor bar is preferably in the range of 9-16 mm, and more preferably in the range of 13-14 mm, the rotational direction of the doctor bar—if the bar does in fact rotate—can have an influence on the microvibrations of the backing web. Thus, for example, a counterrotating doctor bar very effectively prevents the buildup of an air cushion between the doctor bar and the backing web, whereas the reduced friction between the doctor bar and the backing web, which can be reduced to almost zero in the case of a co-rotating doctor bar, exerts a positive effect on the running behavior of the backing web. It was found in the course of numerous experiments that it is also advantageous to design the preferably hard chromium-plated doctor bar in such a way that a liquid, usually water or oil, can be circulated through it for the purpose of cooling. It is also considered preferable for the doctor bar not to be wound, that is, it should be smooth.

Over the course of numerous experiments, it was found advisable for the round element (6) to have a slight forward bend toward the bottom surface of the backing web (1). If the round element (6) is in the form of a doctor bar, this slight forward bend can be replaced by a certain convexity of the doctor bar. Very successful inventive experiments were conducted, for example, with a co-rotating doctor bar with a diameter of 9.5 mm at its outer ends and a diameter of 11.8 mm in the middle.

According to the present invention, the contact line of the round element (6) with the backing web (1) is a certain distance away from the wetting line (3), this distance preferably being in the range of 2-10 cm, and more preferably in the range of 4-6.5 cm. It has been found advisable for the round element (6) and the air guide means (7) to be designed and installed in such a way that they can be moved back and forth in the direction of movement of the backing web (1), so that the distance between the contact line of the round element (6) with the backing web (1) and the wetting line (3) can be adjusted especially within the preferred limits of 2-10 cm to optimize the running of the machine. This distance can then be readjusted at any time.

In a preferred embodiment, the minimum of one guide element (4) is a blade, which is oriented transversely to the direction of movement of the backing web (1) and which is set down onto the top surface of the backing web (1), thus pressing the backing web (1) down slightly. It is possible that the blade could be part of an inking device, where, to form a pigment-containing precoat, an excess quantity of ink is applied first to the top surface of the backing web (1), whereupon the excess ink is scraped off by the blade. Then the curtain coating process is used to apply—in this case an additional—coating material to the as-yet undried ink.

According to the present invention, it is especially preferable, however, for the blade to be a part of an air shield device (8). In particular, it can be an air shield device (8) with an air stream oriented in the travel direction opposite that of the backing web (1). This air stream, beginning just upstream of the wetting line, is applied directly above the backing web (10 to be coated and thus can separate and carry way the air entrained by the backing web (1). Air shield devices, which are basically known in and of themselves, comprise an air supply in the immediate vicinity of the liquid curtain and an air exhauster a certain distance farther away from the liquid curtain. In a case such as this, the distance between the guide element (4), designed as a blade sitting on the backing web (1), and the wetting line (3) is in the range of 4-22 mm, and preferably in the range of 6-12 mm.

The blade is usually ground straight. It is conceivable, however, that the blade could also be provided with a concave or convex grind, as tested successfully in numerous experiments on which the invention is also based, for which reason grinds of this type are also considered preferred embodiments. An especially preferred material for the blade is stainless steel, provided with a coating of flame-cleaned tungsten carbide.

In a preferred embodiment, the width $B_{(2)}$ of the free-falling, vertical curtain (2) is greater than the width $B_{(1)}$ of the backing web (1). A width difference of 10-18%, and preferably of 13-15%, based on the width of the backing web (1), has been found to be especially suitable. The curtain (2), which is preferably not guided along its sides after it has formed, thus falls undivided onto the backing web (1) and covers it over its entire width. Small outer parts of the curtain drop past the backing web (1). The associated liquid coating material is collected in ink troughs, for example, and used again. An application process as described above, in which the outer parts of the curtain fall past the backing web to be coated, offers great advantages with respect to the uniformity of the profile of the coating film to be formed. The necking-in of the dye-containing liquid curtain basically resulting from surface tension, which is often countered by lateral curtain guides and which can result in different layer thicknesses in the formed coating film, thus has no effect of any kind. The precondition for this type of coating, however, is that there may not be any support elements for the backing web (1) directly underneath the wetting line (3), which is considered preferred in accordance with the present invention.

In other preferred embodiments, the width $B_{(4)}$ of the blade serving as the minimum of one guide element (4) and/or the width $B_{(6)}$ of the round element (6) serving as the minimum of one support means (5) and/or the width $B_{(7)}$ of the air guide means (7) is greater in each case than the width $B_{(1)}$ of the backing web (1). It is been found effective with respect to the blade as guide element (4), both for reasons of easier process control and for more flexible process possibilities, for the width difference based on the width $B_{(1)}$ of the backing web (1) not to be less than 0.5%. With respect to the round element (6) and the air guide means (7), a width difference of not less than 0.5% has been found to be especially suitable for the round element (6), whereas a width difference of 10-18%, and preferably of 13-15%, has been found to be suitable for the air guide means (7), based in each case on the width $B_{(1)}$ of the backing web (1).

It is considered especially preferred in the inventive process for the backing web (1) to be guided during the actual coating process, that is, guided in the area of the wetting line (3), at a slight upward angle of more than 0° to 10°, based on the horizontal. In corresponding fashion, the contact angle (β) between the free-falling, vertical curtain (2) and the backing web (1), measured behind the wetting line (3) with respect to the direction of movement of the backing web (1), will be in the range from 80° to less than 90°, for which reason this is considered the preferred range for the contact angle (β).

Proceeding from the zero line of the backing web (1), which, in the absence of the influence of guide element (4) and support means (5), is defined by the mechanical components (rollers $R_1$ and $R_2$) which guide the backing web (1) in the area underneath the components (12) which form the free-falling, vertical curtain (2) of liquid coating material, the minimum of one guide element (4) alone has the effect of pushing the backing web (1) down by a distance in the preferred range of 0.5-3 mm, and especially in a range of 1-2 mm;

the minimum of one support means (5) alone has the effect of raising the backing web (1) by a distance in the preferred range of 1-5 mm, and especially in a range of 1.5-2.5 mm.

Many of the series of experiments on which the present invention is based were conducted with a heat-sensitive coating material, although the invention is not to be considered limited in any way to such material. As a result, a process for producing a heat-sensitive recording material is considered especially preferred, where the process comprises the coating of a continuously moving backing web (1) with a liquid, heat-sensitive coating material by the curtain coating process, where a free-falling, vertical curtain (2) is formed out of the heat-sensitive coating material strikes the backing web (1) along a wetting line (3), where the backing web: is pushed down over its entire width by at least one guide element (4) before passing through the wetting line (3); and is lifted over its entire width by at least one support means (5) after passing through the wetting line (3).

According to the invention, the minimum of one support means (5) comprises a round element (6) extending transversely to the direction of movement of the backing web (1) and air guide means (7) situated behind the round element with respect to the direction of movement of the backing web (1); and between the backing web (1) and the top surface of the air guide means (7), an angle (α) in the range of 2-15°, preferably in the range of 2.5-10.5°, and especially in the range of 2.8-5.5° is maintained.

All embodiments which have been disclosed so far in the present document with respect to the inventive process for applying single or multiple coatings of a liquid coating material to a continuously moving backing web (1) by the curtain coating process but without reference to a heat-sensitive coating material also apply in exactly the same way and without any limitation to the preferred process for the production of heat-sensitive recording material.

In the process thus preferred for forming heat-sensitive recording material, the heat-sensitive coating material comprises at least one dye precursor and at least one preferably organic dye acceptor, where the dye precursor and the dye acceptor react with each other under the effect of heat to produce the dye. Dye precursors selected from the group consisting of phthalide, xanthene, and fluorane compounds have been found to be effective, where xanthene compounds are preferred, and where 3-dibutylamino-6-methyl-7-anilinofluorane and 3-(N-ethyl-N-isopentyl)amino-6-methyl-7-anilinofluorane are especially preferred. In addition to these, the recording layer can also contain one or more of the uncolored or weakly colored dye precursors already known in principle such as xanthene, fluorane, triarylmethane, diphenylmethane, fluorene, oxazine, thiazine, and spiropyrane compounds or mixtures of them.

Typical compounds of this type include the following by way of example:

Xanthene compounds:

rhodamine-B-anilinolactam,
rhodamine-B-p-chloroanilinolactam,
3-diethylamino-7-dibenzylaminofluorane,
3-diethyl amino-7-octylaminofluorane,
3-diethylamino-7-phenylfluorane,
3-diethylamino-7-chloro fluorane,
3-diethylamino-6-chloro-7-methylfluorane,
3-diethylamino-7-(3,4-dichloroanilino)fluorane,
3-diethylamino-7-(2-chloroanilino)fluorane,
3-diethylamino-6-methyl-6-anilinofluorane,
3-(N-ethyl-N-tolyl)amino-6-methyl-7-anilinofluorane,
3-piperidino-6-methyl-7-anilinofluorane,
3-(N-ethyl-N-tolyl)amino-6-methyl-7-phenylethylfluorane,
3-diethylamino-7-(4-nitroanilino)fluorane,
3-(N-methyl-N-propyl)amino-6-methyl-7-anilinofluorane,
3-(N-methyl-N-cyclohexyl)amino-6-methyl-7anilinofluorane,
3-(N-ethyl-N-tetrahydrofuryl)amino-6-methyl-7-anilinofluorane, etc.

Triarylmethane compounds:

3,3-bis(p-dimethylaminophenyl)-6-dimethylaminophthalide (crystal violet lactone),
3,3-bis(p-dimethylaminophenyl)phthalide,
3-(p-dimethylaminophenyl)-3-(1,2-dimethylindol-3-yl)phthalide,
3-(p-dimethylaminophenyl)-3-(2-methylindol-3-yl)phthalide,
3-(p-dimethylaminophenyl)-3-(2-phenylindol-3-yl)phthalide,
3,3-bis(1,2-dimethylindol-3-yl)-5-dimethylaminophthalide,
3,3-bis(1,2-dimethylindol-3-yl)-6-dimethylaminophthalide,
3,3-bis(9-ethylcarbazol-3-yl)-5-dimethylaminophthalide,
3,3-bis(2-phenylindol-3-yl)-5-dimethylaminophthalide,
3-p-dimethylaminophenyl-3-(1-methylpyrrol-2-yl)-6-dimethylaminopthalide, etc.

Diphenylmethane compounds:

4,4'-bis(dimethylaminophenyl)benzhydrylbenzyl ether,
N-halophenylleucoauramine,
N-2,4,5-trichlorophenylleucoauramine, etc.

Thiazine Compounds:

benzoylleucomethylene blue,
p-nitrobenzoylleucomethylene blue, etc.

Spiropyrane Compounds:

3-methylspirodinaphthopyrane,
3-ethyl spirodinaphthopyrane,
3,3-dichlorospirodinaphthopyrane,
3-benzylspirodinaphthopyrane,
3-methylnaphtho-(3-methoxybenzo)spiropyrane,
3-propylspirobenzopyrane, etc.

The heat-sensitive coating material can also contain, for example, one or more of the following near-infrared absorbers:

3,6-bis(dimethylamino)fluorene-9-spiro-3'-(6'-dimethylaminophthalide),
3-diethylamino-6-dimethylaminofluorene-9-spiro-3'-(6'-dimethylaminophthalide),
3,6-bis(diethylamino)fluorene-9-spiro-3'-(6'-dimethylaminophthalide),
3-dibutylamino-6-diethylaminofluorene-9-spiro-3'-(6'-dimethylaminophthalide),
3-dibutylamino)fluorene-9-spiro-3'-(6'-diethylaminophthalide),
3,6-bis(dimethylamino)fluorene-9-spiro-3'-(6'-diethylaminophthalide),
3-diethylamino-6-dimethylaminofluorene-9-spiro-3'-(6'-diethylaminophthalide),
3-dibutylamino-6-dimethylaminofluorene-9-spiro-3'-(6'-diethylaminophthalide),
3,6-bis(diethylamino)fluorene-9-spiro-3'-(6'-diethylaminophthalide),
3,6-bis(dimethylamino)fluorene-9-spiro-3'-(6'-dibutylaminophthalide),
3-dibutylamino-6-diethylaminofluorene-9-spiro-3'-(6'-diethylaminophthalide),
3-diethylamino-6-dimethylaminofluorene-9-spiro-3'-(6'-dibutylaminophthalide),
3,3-bis[2-(4-dimethylaminophenyl)-2-(4-methoxyphenyl)-ethenyl]-4,5,6,7-tetrachlorophthalide, etc.

Organic dye acceptors are preferred, especially those selected from the group consisting of:

2,2-bis(4-hydroxyphenyl)propanes;
4[(4-(1-methylethoxy)phenyl)sulfonyl]phenols;
4,4'-dihydroxydiphenylsulfones;
N-(p-toluenesulfonyl)-N'-(3-p-toluenesulfonyloxyphenyl) ureas;
2,4'-dihydroxydiphenylsulfones;
N-(2-hydroxyphenyl)-2-[(4-hydroxyphenyl)thio]acetamides, without, of course, any limitation to the dye acceptors cited. For the dye acceptors, an average particle size in the range from more than 0.3 μm to a maximum of 1 μm, and especially from 0.45 μm to 0.9 μm, is recommended. The limits are imposed in the upward direction by too little sensitivity and in the downward direction by an otherwise excessive tendency of the heat-sensitive recording material to turn gray.

In an especially preferred embodiment of the claimed process for producing heat-sensitive recording material, the backing web (1) comprises at least one pigment-containing coating (9), onto which then, to form the heat-sensitive recording layer (10), the heat-sensitive coating material is applied by the curtain coating process. A coating (9) of this type, comprising primarily inorganic pigments and suitable binders, can have a very positive effect on the reaction of the recording layer (10) to the heat supplied by a thermal print head. If, in addition to the inorganic pigments, organic or so-called hollow pigments, which have air in their interiors and therefore act as good heat insulators, are incorporated into the pigment-containing coating (9), a pigment-containing coating (9) of this type acts as a heat reflector, which focuses the heat which is emitted by the thermal print head and which passes through the recording layer (10) back into the heat-sensitive recording layer (10). It is therefore also possible not only to improve the response but also to increase the resolution of the heat-sensitive recording layer (10).

The organic pigments of the pigment-containing coating (9) are preferably within a wall of thermoplastic resin, which preferably comprises (meth)acrylonitrile copolymer, polyvinyl chloride, polyvinylidene chloride, polystyrene, styrene acrylate, polyacrylonitrile, or polyacrylic acid ester. Pigment mixtures of various organic pigments are also conceivable.

Preferred inorganic pigments in the pigment-containing coating (9) which have proven effective include those from the group consisting of natural and calcined kaolin, silicon oxide, bentonite, calcium carbonate, and aluminum oxide, especially boehmite. Mixtures of several different inorganic pigments are also conceivable.

The quantitative ratio between organic and inorganic, oil-absorbing pigment is a compromise between the effects brought about by the two pigment types. This compromise is reached in an especially advantageous manner when the pigment mixture consists of 15-50 wt. %, and preferably 25-40 wt. %, of organic pigment and 85-50 wt. %, and preferably 75-60 wt. %, of inorganic pigment.

In addition to the organic and/or inorganic pigments, the pigment-containing coating (9) contains binders, selected from the group consisting of polyvinyl alcohol, styrene-butadiene latex, starch, carboxymethylcellulose, and cellulose derivatives, where styrene-butadiene latex is especially preferred. In the case of binder mixtures, the binder component in the pigment-containing coating (9) preferably consists of 69-76 wt. % of styrene-butadiene latex.

A preferred pigment-containing coating (9) can also make a positive contribution to the leveling of the surface of the backing web (1), as a result of which the quantity of coating material for the heat-sensitive recording material (10) which must be applied can be reduced. For this reason, leveling coating devices such as roll coaters, doctor knives, and knife-over-roll coaters are recommended for the application of the pigment-containing coating (9). If the inorganic pigments incorporated into the pigment-containing coating (9) are oil-absorbing pigments, these can absorb the wax components of the heat-sensitive recording material (10) which have become liquefied by the heat from the thermal print head during development of the graphic image, which makes it possible to improve and to accelerate the heat-induced recording.

The basis weight of the pigment-containing coating (9) is preferably in the range of 5-20 g/m$^2$, and more preferably between 6 and 10 g/m$^2$. In the case of the heat-sensitive recording layer (10), the basis weight is preferably in the range of 2-8 g/m$^2$, and more preferably in the range of 2.5-6 g/m$^2$.

The backing web (1) is made up not only of at least one preferred pigment-containing coating (9) but also of a substrate (11). Even though the substrate (11) is not limited to paper, paper is preferred as the substrate (11) in accordance with the invention, especially a coating base paper without surface treatment, which has also been commercially successful for environmental reasons by virtue of its good recyclability. A coating base paper without surface treatment is understood to be here a coating base paper which has not been treated in a size press or in a coating device. Films of polyolefin, for example, and paper coated with polyolefin are also equally possible as substrates (11) in accordance with the invention, but these choices are not to be considered exclusive in character.

The present invention is also directed at a device for applying single or multiple coatings of liquid coating material to a continuously moving backing web (1) by the curtain coating process, comprising:

components (12) for forming a free-falling, vertical curtain (2) of the liquid coating material, which strikes the backing web (1) along a wetting line (3);

at least one guide element (4) for pressing the backing web (1) down over its entire width in front of the wetting line with respect to the direction of movement of the backing web (1); and at least one support means (5) for raising the backing web (1) over its entire width behind the wetting line (3) with respect to the direction of movement of the backing web (1).

According to the invention, the minimum of one support means (5) comprises a round element (6) extending transversely to the direction of movement of the backing web (1) and air guide means (7) situated behind the round element (6) with respect to the direction of movement of the backing web (1);

wherein between the backing web (1) and the top surface of the air guide means (7), an angle ($\alpha$) in the range of 2-15°, preferably in the range of 2.5-10.5°, and especially in the range of 2.8-5.5°, is maintained.

Without limitation to any one of the special components (12) for forming a free-falling, vertical curtain (2) of the liquid coating material, two types in particular are considered especially preferred, the so-called slot coater, in which the liquid coating material emerges from a downward-pointing discharge slot extending transversely toward the backing web (1) to be coated and then immediately forms a free-falling liquid curtain, and the so-called slide-surface coater. Here the liquid coating material is first applied to a downward-slanting slide, where it forms a thin film and flows down the slide under the force of gravity, forming the free-falling liquid curtain at the end of the slide.

Previously described preferred embodiments of the claimed process for applying single or multiple coatings of liquid coating material to a continuously moving backing web by the curtain coating process are also intended to be correspondingly preferred embodiments of the device to be used for this purpose. Thus, the preferred round element (6) is a doctor bar, in which case it is then considered especially advantageous for the air guide means (7) to be designed as a holder for the round element or for the doctor bar. A preferred embodiment in accordance with the device proposed here is a smooth doctor bar, although a profiled, possibly a wound doctor bar is also possible and can offer good results. Depending on the design, all of which are considered preferred in accordance with the present document, the doctor bar is stationary or rotatable, where the direction of its rotation in reference to the direction of movement of the backing web (1) can be the same, which means that the surface of the doctor bar in the contact area with the backing web (1) has the same orientation as the direction of movement of the backing web (1); or alternatively it can have the opposite orientation. Numerous experiments have shown that it is also advantageous to design the hard chromium-plated doctor bar in such a way that that a liquid, usually water or oil, can be circulated through it and thus cool it.

With respect to the diameter of the doctor bar, a range of 9-16 mm, and especially a range of 13-14 mm, is preferred. Numerous experiments have shown that it is effective for the doctor bar to have a slight forward bend in the direction toward the bottom surface of the backing web (1). If a doctor bar without a forward bend is preferred, this forward bend can be replaced by a convexity. Very successful inventive experiments were conducted with a co-rotating doctor bar with a diameter of 9.5 mm at its outer ends and a diameter of 11.8 mm in the middle.

According to a preferred embodiment, the contact line between the doctor bar and the backing web (1) is preferably 2-10 cm, and more preferably 4-6.5 cm, from the wetting line (3). Ideally, the doctor bar, in correspondence with its preferred embodiments, and the air guide means (7), preferably designed as a doctor bar holder, are designed so that they can be moved back and forth in the direction of movement of the backing web (1), so that the distance between the contact line of the doctor bar with the backing web (1) and the wetting line (3) can be set to a value within the preferred range of 2-10 cm for the purpose of optimizing the running of the machine. This distance can then be readjusted at any time.

The claimed device for applying single or multiple coatings of a liquid coating material to a continuously moving backing web (1) by the curtain coating process comprises preferably an air shield device (8), as a part of which the guide element (4) is designed in the form of a blade oriented transversely to the direction of movement of the backing web (1). The distance between the blade sitting on the backing web (1) and the wetting line (3) is in the range of 4-22 mm, and most preferably in the range of 6-12 mm. The blade is usually ground straight; it is also conceivable that the blade could be given a convex or a concave grind, both of which have been successfully tested in numerous experiments on which the invention is also based, for which reason a grind of either of these two types is also considered a preferred embodiment. An especially preferred material for the blade is stainless steel, provided with a coating of flame-cleaned tungsten carbide.

In particular, the preferred air shield device (8) can be a device with an air stream oriented in the travel direction opposite that of the backing web (1), where the air stream, beginning just in front of the wetting line, is applied directly above the backing web (1) to be coated and can thus separate and carry away the air entrained by the backing web (1). The air shield device (8) preferably comprises an air supply in the immediate vicinity of the liquid curtain and an air exhauster a certain distance farther away from the liquid curtain.

Inventive devices, numerous embodiments of which have been described here, and the processes, numerous embodiments and variants of which have also been proposed here, for applying single or multiple coatings of liquid coating material to a continuously moving backing web by the curtain coating process, in which a free-falling, vertical curtain is formed out of the possibly heat-sensitive coating material, make it possible to operate during the coating operation at speeds in the range above 1,200 m/min or even above 1,500 m/min without the occurrence of coating defects in the form of, for example, skipping. The proposed processes and devices are thus able to solve convincingly the problem on which the invention in all its embodiments and variants is based.

The information given in the description pertaining to basis weight, percentage by weight (wt. %), and parts by weight pertain in each case to absolutely dry weight. In the discussion of the organic pigments of the pigment-containing coating, the associated numerical data are calculated on the basis of the "air-dried" weight, i.e., parts by weight when dried by exposure to the air, minus the weight fraction attributable to water around and in the interior of the pigments in their as-delivered form.

DETAILED DESCRIPTION OF THE PREFERRED EMBODIMENTS

Figure 1:
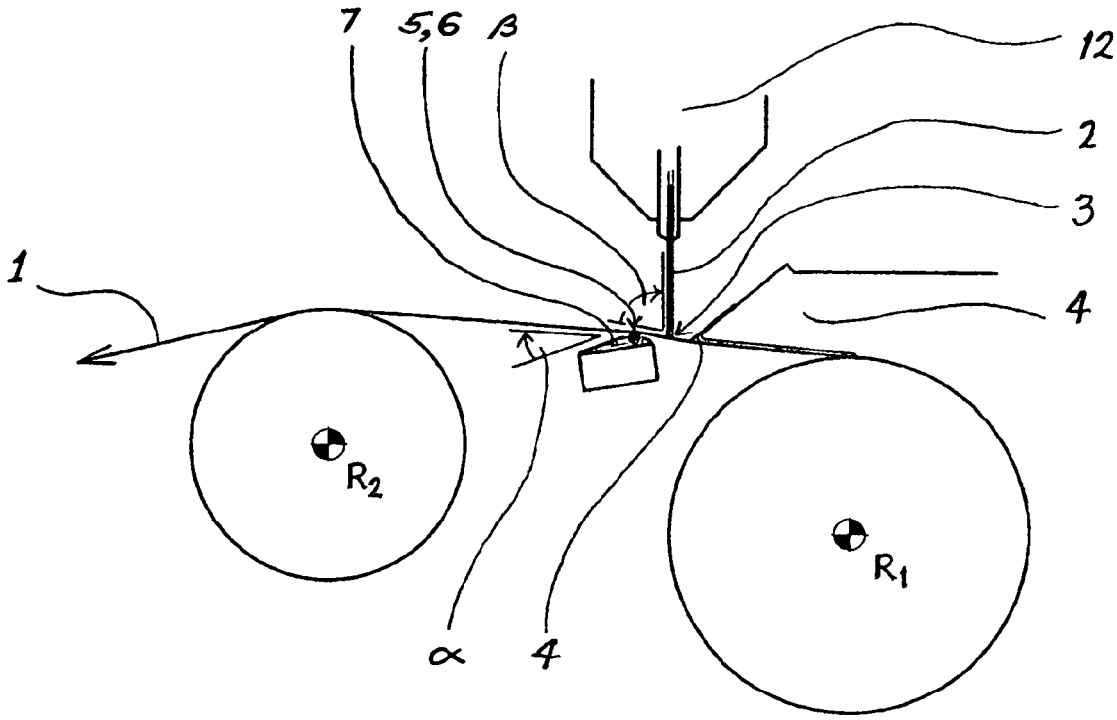
FIG. 1 is a schematic view of the apparatus and method according to the invention.

One embodiment of the inventive process is illustrated in FIG. 1, in which a backing web (1) is shown, which is being conducted by means of the two guide rollers $R_1$ and $R_2$, both of which are symbolized as driven, underneath the components (12) which form the curtain (2) of liquid coating material. It is to be assumed in the present case that the backing web (1) is a substrate of paper with a basis weight of 58 g/m$^2$ to which a pigment-containing coating of 8 g/m$^2$ has been applied and that a so-called slot coater is used to form the curtain (2). The coater is the only one of the components (12) to be illustrated. The slot coater produces a free-falling curtain (2) of liquid, heat-sensitive coating material, which is shown underneath the components (12) of the slot coater. The curtain (2) strikes the backing web (1) along the wetting line (3) at an angle (β) here of 85° to the backing web (1), where the heat-sensitive coating material of the curtain (1) forms a heat-sensitive recording layer with a basis weight of 4 g/m$^2$.

Certain parts of an air shield device (8), which is designed as a so-called "AirCut" and has components (not shown) for creating an air stream oriented in the direction opposite that of the movement of the backing web (1) to separate and to carry away the air entrained by the backing web (1), can be seen on the guide roller $R_1$ a certain distance away. Near the curtain (2), underneath the components (12) which form the curtain, the air shield device (8) is terminated by a straight-ground blade, which, serving as a guide element (4), pushes the backing web (1) down directly over its entire width in front of the wetting line (3) or, more specifically, at a distance of 8 mm upstream of the wetting line with respect to the direction of movement of the backing web (1), which travels from the guide roller $R_1$ to the guide roller $R_2$.

5 cm downstream of the wetting line (3), the backing web (1) is raised by a support means (5), designed as a round element (6) in the form of a nonrotating, smooth doctor bar with a uniform diameter of 13.2 mm. The doctor bar is mounted in a holder situated behind the doctor bar with respect to the direction of movement of the backing web (1). Between the top surface of the air guide means (7) and the backing web (1), an angle (α) of 4.5° is maintained, which, in the present case, is shown larger than it really is so that it can be seen more easily in the drawing.

If we consider in the drawing the position of the backing web (1) between the contact points of the backing web (1) with the two guide rollers $R_1$ and $R_2$, and if we correct the course of the backing web (1) with respect to its deflections by the guide element (4) and the support means (5) in such a way that no deflections at all are present in the course of the backing web (1) between the two guide rollers $R_1$ and $R_2$, we obtain the course of the (imaginary) zero line. Proceeding from this zero line, the blade which serves as the guide element (4) has the effect, alone and without the influence of the doctor bar as support means (5), of pressing the backing web (1) down—in the present case down by 1.5 mm. In exactly the same way, the doctor bar which serves as the support means (5) has the effect, alone and without the influence of the blade as guide element (4), of raising the backing web (1)—in the present case up by 2.0 mm.

Figure 2:
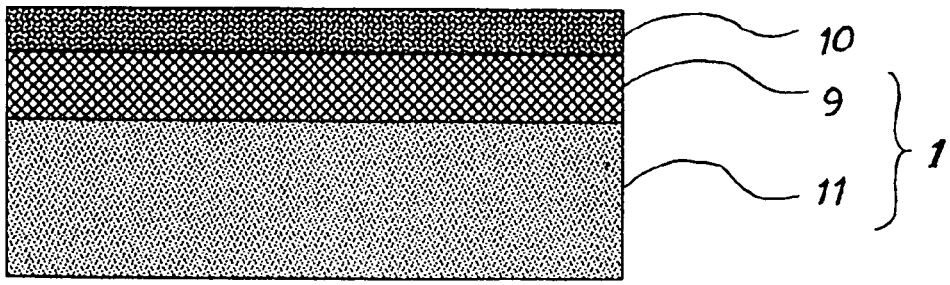
FIG. 2 shows a heat sensitive recording material produced by the method according to the invention.

FIG. 2 shows a heat-sensitive recording material like that which can be produced by the process illustrated in FIG. 1. The recording material comprises, in this order, the substrate (11), here of paper with a basis weight of 58 g/m$^2$; the pigment-containing coating (9), here with a basis weight of 8 g/m$^2$, where the substrate (11) and the pigment-containing coating (9) together constitute the backing web (1) to be coated by the curtain coating process; and finally the heat-sensitive recording layer (10), here with a basis weight of 4 g/m$^2$.

What is claimed is:

1. A process for applying at least one coating to a backing web which is moving continuously in a direction, the backing web having a width B1, the process comprising:

pressing the web down by at least one guide element extending over the entire width of the web;

passing the web under a free-falling vertical curtain of liquid coating material which strikes the backing web along a wetting line extending across the width of the web downstream of the guide element; and lifting the web over its entire width after passing through the wetting line, the lifting being done by a round element extending transversely to the direction of movement of the backing web and an air guide situated downstream of the round element in the direction of movement, wherein the air guide has a top surface which diverges from the web in the direction of movement at an angle α of 2-15°.

2. The process of claim 1 wherein the coating material is a heat-sensitive coating material, whereby a heat sensitive recording material is produced.

3. The process of claim 2 wherein the heat-sensitive coating material has at least one dye precursor selected from the group of the phthalide, xanthene, and fluorane compounds, and at least one organic dye acceptor, selected from the group consisting of:

2,2-bis(4-hydroxyphenyl)propanes;

4-[(4-(1-methylethoxy)phenyl)sulfonyl]phenols;

4,4'-dihydroxydiphenylsulfones;

N-(p-toluenesulfonyl)-N'-(3-p-toluenesulfonyloxyphenyl)ureas;

2,4'-dihydroxydiphenylsulfones; and

N-(2-hydroxyphenyl)-2-[(4-hydroxyphenyl)thio]acetamides, wherein the dye precursor and the dye acceptor react with each other under the effect of heat to form the dye.

4. The process of claim 3 wherein the backing web comprises a paper substrate and a pigment-containing coating, the heat sensitive coating material forming a heat-sensitive recording layer.

5. The process of claim 4 wherein the pigment containing coating contains a mixture of organic and inorganic pigments.

6. The process of claim 4 wherein the pigment containing coating contains inorganic pigments selected from the group consisting of natural and calcined kaolin, silicon oxide, bentonite, calcium carbonate, and aluminum oxide.

7. The process of claim 1 wherein the round element is a doctor bar.

8. The process of claim 7 wherein the air guide serves as a holder for the doctor bar.

9. The process of claim 7 wherein the doctor bar rotates as the web moves thereover, the doctor bar having a surface which moves in the same direction as the web.

10. The process of claim 7 wherein the doctor bar has outer ends and a middle section, the outer ends having a smaller diameter than the middle section.

11. The process of claim 7 further comprising circulating a liquid through the doctor bar for cooling.

12. The process of claim 1 further comprising moving the round element and the air guide back and forth together in the direction of movement of the backing web.

13. The process of claim 1 wherein the curtain of liquid has a width B2 which is greater than the width B1 of the backing web.

14. The process of claim 1 wherein the at least one guide element comprises a blade oriented transversely to the direction of movement of the backing web.

15. The process of claim 1 wherein the blade is part of an air shield device.

16. The process of claim 1 wherein the blade has one of a concave and a convex grind.

17. The process of claim 1 wherein the blade has a width B4, the round element has a width B6, and the air guide has a width B7, wherein at least one of the widths B4, B6, B7 is greater than the width B1 of the backing web.

18. The process of claim 1 wherein the vertical curtain forms a contact angle with the backing web downstream of the wetting line, wherein the contact angle is in the range of 80° to less than 90°.

19. An apparatus for applying at least one coating to a backing web which is moving continuously in a direction, the backing web having a width B1, the apparatus comprising:

at least one guide element for pressing the web down over the entire width of the web;

a free-falling vertical curtain of liquid coating material which strikes the backing web along a wetting line extending across the width of the web downstream of the guide element; and a round element extending transversely to the direction of movement of the backing web for lifting the web over its entire width after passing through the wetting line; and an air guide situated downstream of the round element in the direction of movement, wherein the air guide has a top surface which diverges from the web in the direction of movement at an angle α of 2-15°.

20. The apparatus of claim 19 wherein the round element is a doctor bar and the air guide serves as a holder for the doctor bar.

21. The apparatus of claim 20 wherein the doctor bar has outer ends and a middle section, the outer ends having a smaller diameter than the middle section.

22. The apparatus of claim 19 wherein the round element and the air guide are mounted so that they can move back and forth together in the direction of movement of the backing web.

* * * * *